US007210267B2

(12) United States Patent
VerSteeg et al.

(10) Patent No.: US 7,210,267 B2
(45) Date of Patent: May 1, 2007

(54) NON-TAKEOUT LOCK FOR A PIVOT PIN OF TILT-TYPE WINDOWS

(75) Inventors: Lawrence John VerSteeg, Sioux Falls, SD (US); Gary Roger Newman, Valley Springs, SD (US)

(73) Assignee: Amesbury Group, Inc., Amesbury, MA (US)

( * ) Notice: Subject to any disclaimer, the term of this patent is extended or adjusted under 35 U.S.C. 154(b) by 341 days.

(21) Appl. No.: 10/775,026

(22) Filed: Feb. 9, 2004

(65) Prior Publication Data

US 2005/0172560 A1 Aug. 11, 2005

(51) Int. Cl.
*E05D 15/22* (2006.01)

(52) U.S. Cl. ..... 49/181; 49/176; 49/446

(58) Field of Classification Search ..... 49/181, 49/176, 445, 446, 447
See application file for complete search history.

(56) References Cited

U.S. PATENT DOCUMENTS

| | | | | |
|---|---|---|---|---|
| 4,227,345 | A | 10/1980 | Durham, Jr. | |
| 4,364,199 | A | 12/1982 | Johnson et al. | |
| 4,610,108 | A | 9/1986 | Marshik | |
| 4,683,676 | A | 8/1987 | Sterner, Jr. | |
| 4,887,389 | A | 12/1989 | Haltof | |
| 4,914,861 | A | 4/1990 | May | |
| 4,922,657 | A | 5/1990 | Foss | |
| 4,941,285 | A | 7/1990 | Westfall | |
| 4,949,425 | A * | 8/1990 | Dodson et al. | 16/198 |
| 5,069,001 | A | 12/1991 | Makarowski | |
| 5,077,939 | A | 1/1992 | Erickson | |
| 5,243,783 | A | 9/1993 | Schmidt et al. | |
| 5,301,467 | A | 4/1994 | Schmidt et al. | |
| 5,463,793 | A | 11/1995 | Westfall | |
| 5,542,212 | A | 8/1996 | Erickson et al. | |
| 5,544,450 | A | 8/1996 | Schmidt et al. | |
| 5,566,507 | A | 10/1996 | Schmidt et al. | |
| 5,615,452 | A | 4/1997 | Habbersett | |
| 5,704,165 | A | 1/1998 | Slocomb et al. | |
| 5,836,111 | A | 11/1998 | Tak | |
| 5,873,199 | A | 2/1999 | Meunier et al. | |
| 6,041,475 | A * | 3/2000 | Nidelkoff | 16/193 |
| 6,119,398 | A | 9/2000 | Yates, Jr. | |
| 6,658,794 | B1 * | 12/2003 | Hansel et al. | 49/181 |
| 6,990,710 | B2 * | 1/2006 | Kunz et al. | 16/193 |
| 2003/0145523 | A1 * | 8/2003 | Annes et al. | 49/181 |

* cited by examiner

*Primary Examiner*—Gregory J. Strimbu
(74) *Attorney, Agent, or Firm*—Goodwin Procter LLP

(57) ABSTRACT

A slide block for slideably and pivotally mounting a window sash to a side member of a window frame having a vertical window jamb channel. The slide block includes a body, the body defining a sash pivot-receiving aperture. A sash pivot retainer spring is integrally formed with the body and is positionable between a first position obstructing removal of a sash pivot when the sash pivot is disposed in the aperture and a second position permitting removal of the sash pivot.

5 Claims, 11 Drawing Sheets

NON-TAKEOUT LOCK FOR A PIVOT PIN OF TILT-TYPE WINDOWS

FIELD OF THE INVENTION

The invention relates to tilt window devices for single and double hung windows and, more particularly, to a tilt-out type window device that includes a non-takeout locking shoe mechanism.

BACKGROUND OF THE INVENTION

Double-hung, tilt-out type windows have become increasingly popular. Much of this popularity is due to the tilt-out feature, which allows both the inside and outside surfaces of the glazing to be cleaned from the inside and facilitates removal and replacement of a damaged sash.

Various tilt-out windows have been equipped with slide blocks, such as the one disclosed in U.S. Pat. No. 4,610,108 to Marshik, the disclosure of which is hereby incorporated by reference herein in its entirety. Marshik discloses a double-hung window having a frame with a set of parallel jamb channels on opposite sides of the frame. Within each jamb channel is a slideably mounted block. A spring balance mechanism is attached to a headplate on each block. A connecting pin extends from opposite sides of a sash into an opening in a locking cam member housed within the block. The pivots allow the sash, which holds the glazing, to be rotated or tilted toward the inside of a room. As the pivots rotate, the cam forces serrated ends of a spring into opposite sides of the jamb channel to lock the block to the frame, thereby preventing the spring balance from moving the block and the sash.

The connecting pin can become disconnected from the block when the sash is tilted toward the inside of a room, if the operator inadvertently lifts while tilting the sash. This can cause the sash to disengage from the frame, requiring realignment prior to tilting the sash back into place. Conventional retention features can be difficult to operate and costly to manufacture. See, for example, the Locking Slide Block of U.S. Pat. No. 5,243,783 to Schmidt, the disclosure of which is hereby incorporated by reference herein in its entirety.

SUMMARY OF THE INVENTION

The present invention solves the problem of the inadvertent release of a tilt-out type of window sash by providing a non-takeout locking mechanism that prevents removal of the window sash from the block and jamb without the advertent act of releasing the locking mechanism in the block.

In one aspect, the invention relates to a slide block for a tilt window sash that includes a body adapted to be received in a window jamb channel, the body defining a sash pivot receiving aperture. The tilt sash also includes a sash pivot retainer spring integrally formed with the body, the spring positionable between a first position obstructing removal of a sash pivot when the sash pivot is disposed in the aperture and a second position permitting removal of the sash pivot.

In another aspect, the invention relates to a window balance system for use in a window jamb with a tilt window sash. The balance system includes a window balance and a slide block coupled to the window balance. The slide block includes a body adapted to be received in a window jamb channel, the body defining a sash pivot receiving aperture. The balance system also includes a sash pivot retainer spring integrally formed with the body, the spring positionable between a first position obstructing removal of a sash pivot when the sash pivot is disposed in the aperture and a second position permitting removal of the sash pivot. In one embodiment, the window balance is a block and tackle type balance.

In another aspect, the invention relates to a tilt-in window sash assembly. The assembly includes a frame that includes a window jamb forming a channel. Also included is at least one tilt-in window sash, the tilt-in window sash operatively slideable in the window jamb and tiltable with respect to the window jamb. At least one window balance is coupled to a slide block disposed in the window jamb channel. The slide block includes a body adapted to be received in the window jamb channel, where the body defines a sash pivot-receiving aperture. Also included in the slide block is a sash pivot retainer spring integrally formed with the body, the spring positionable between a first position obstructing removal of a sash pivot when the sash pivot is disposed in the aperture and a second position permitting removal of the sash pivot.

In another aspect, the invention relates to a method of selectively retaining a tilt window sash within a window frame to prevent inadvertent removal of the sash. The method includes the step of coupling the sash to the frame with a pivot bar and a slide block. The slide block includes a body adapted to be received in a window jamb channel, the body defining a sash pivot-receiving aperture. The slide block also includes a sash pivot retainer spring integrally formed with the body, where the spring is positionable between a first position obstructing removal of a sash pivot when the sash pivot is disposed in the aperture and a second position permitting removal of the sash pivot. The method further includes the step of retaining the sash within the frame by occluding at least a portion of the pivot-receiving aperture with the sash pivot retainer spring in the first position.

In one embodiment, the method includes the step of removing the sash by manually actuating the sash pivot retainer spring to the second position. The spring can be actuated by deflecting the sash pivot retainer spring. The deflecting step can include contacting the sash pivot retaining spring with a pivot-removal tool to deflect sash pivot retainer spring to the second position, thereby allowing for removal of the sash pivot from the pivot-receiving aperture. In another embodiment, the method includes manually actuating a pair of sash pivot retainer springs to the second position by deflecting the pair of opposing sash pivot retainer springs. The deflecting step can include inserting a pivot-removal tool between the pair of opposing sash pivot retainer springs, the pivot-removal tool deflecting the pair of opposing sash pivot retainer springs to the second position, thereby allowing for removal of the sash pivot from the pivot-receiving aperture.

In various embodiments of the foregoing aspects, the body can further include oppositely disposed sliding surfaces for guiding the body in the window jamb channel. The sash pivot retainer spring can include an elongated locking arm including a first end integrally formed with the body and a second end deflectable between the first position and the second position. In another embodiment, the slide block can include a second sash pivot retainer spring integrally formed with the body, where the spring is positionable between the first position obstructing removal of the sash pivot when the sash pivot is disposed in the aperture and the second position permitting removal of the sash pivot. In some embodiments, the first and second sash pivot retainer springs are configured opposite each other.

The second sash pivot retainer spring can include an elongated locking arm including a first end integrally formed with the body, and a second end deflectable between the first position and the second position. In another embodiment, the respective second ends of the first and second sash pivot retainer springs engage each other responsive to application of a removal force to the sash pivot.

The slide block can also include a locking mechanism for selectively engaging the window jamb channel and locking the block in a fixed position. The locking mechanism can include a cam carried in the body, the cam including camming surfaces to contact and operate the locking mechanism. The cam defines the sash pivot-receiving aperture having an open top slot. The locking mechanism can further include a locking spring having oppositely disposed serrated end portions, the spring disposed about the cam and operated by contacting the camming surfaces.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Figure 1:
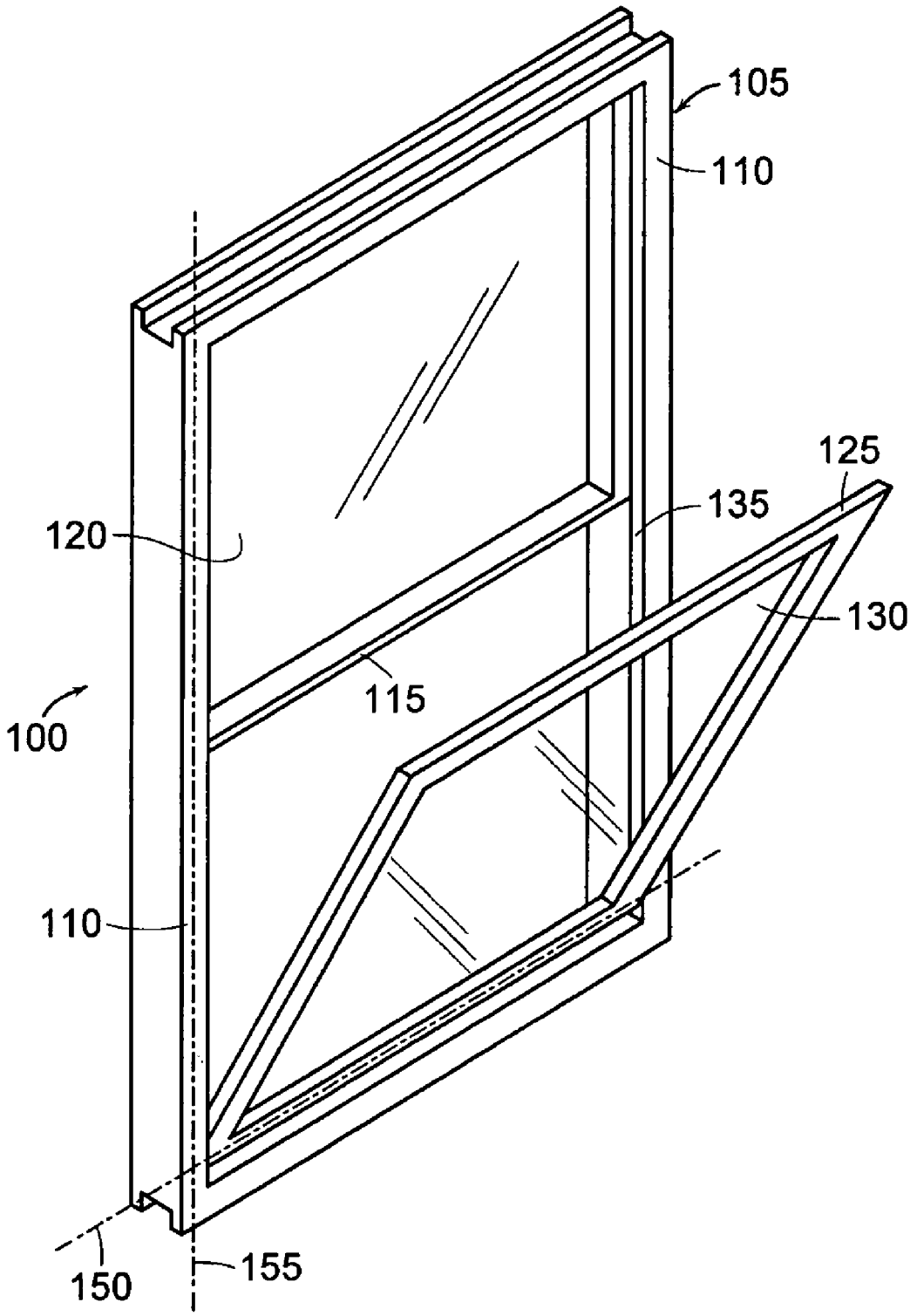
FIG. 1 is a schematic perspective view of one embodiment of a double-hung tilt-type window assembly in accordance with the invention with a partially tilted sash.

FIG. 1 shows one embodiment of a double-hung tilt-out window assembly 100. The window assembly 100 has a frame 105, an upper sash 115, and a lower sash 125; the upper and lower sashes 115, 125 each supporting windowpanes 120, 130 respectively. The frame 105 also has four jamb channels 135, one of which is shown in FIG. 1, on a side member 110 of the frame 105. One jamb channel 135 is proximate each side of the upper sash 115 and the lower sash 125. As shown in FIG. 1, the lower sash 125 is partially tilted, so that both sides of the windowpane 130 within the lower sash 125 are accessible for cleaning from the same side of the window assembly 100.

Figure 2:
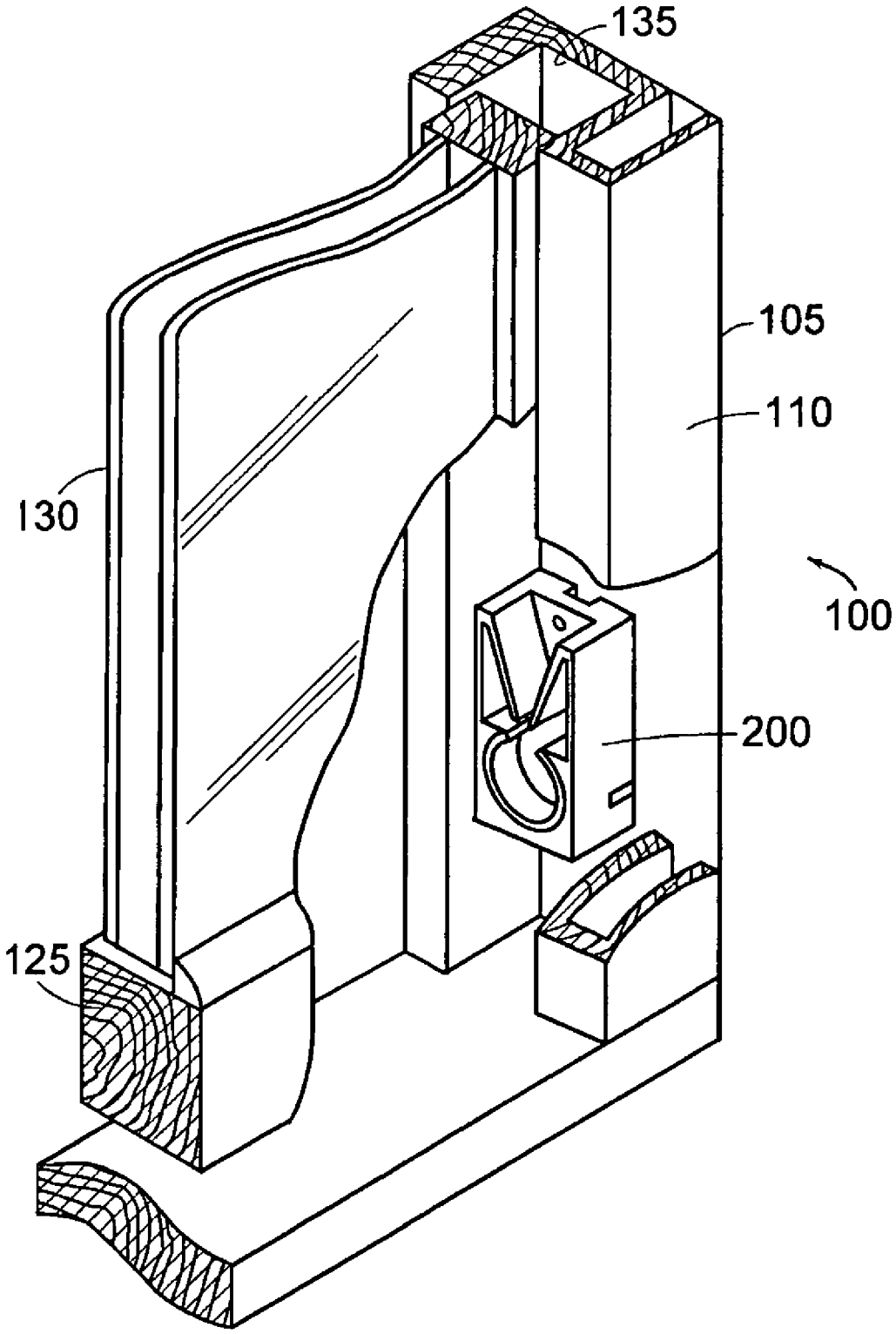
FIG. 2 is a cutaway schematic perspective view of a portion of the window assembly of FIG. 1 illustrating one embodiment of a non-takeout type slide block in accordance with the invention.
Figure 6B:
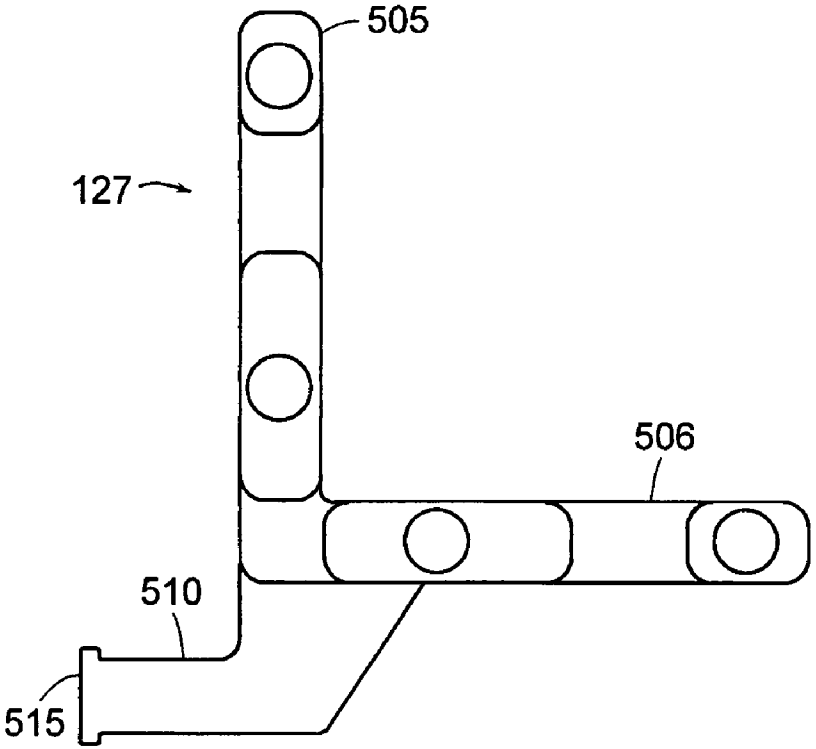
FIGS. 6A and 6B are schematic end and side views, respectively, of one embodiment of a window sash pivot in accordance with the invention.
Figure 6A:
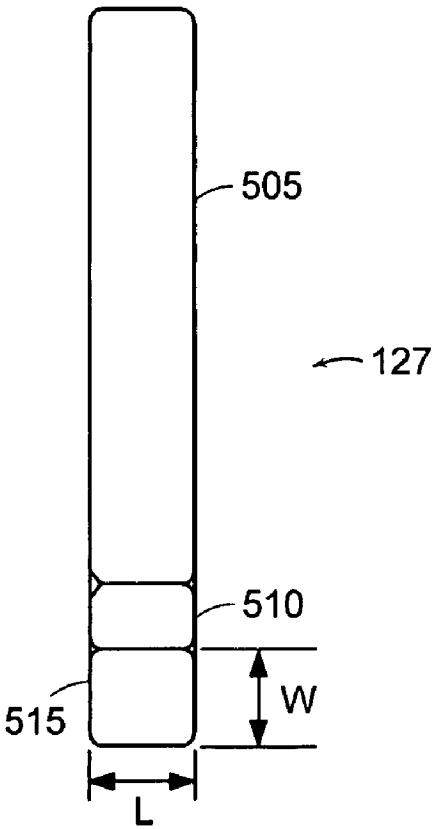

FIG. 2 is a cutaway view of a portion of the window assembly 100 of FIG. 1 depicting a slide block 200 disposed between the side member 110 of the frame 105 and the lower sash 125. One slide block 200 is slideably mounted within each jamb channel 135. Fastened to lower opposite sides of the sash 125 is a pivot 127 (FIGS. 6A and 6B). The pivots 127 are supported for rotation by the slide blocks 200. The sash 125 is tiltable about a horizontal axis 150 (FIGS. 1 and 8) through the pivots 127 disposed on opposite sides of the sash 125.

Figure 3:
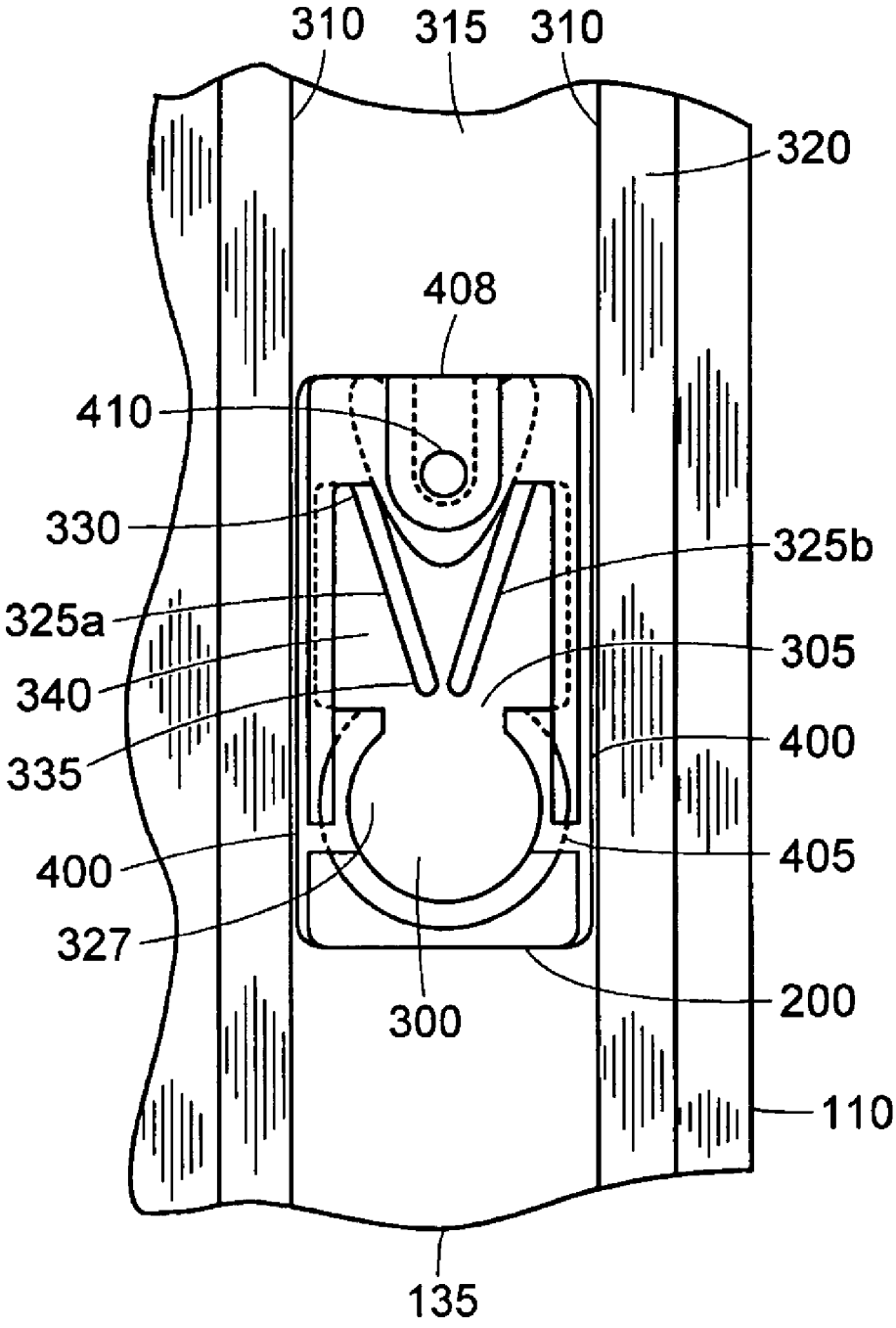
FIG. 3 is a schematic front view of the non-takeout type slide block of FIG. 2, installed within a window jamb.

FIG. 3 depicts the slide block 200 inserted in the jamb channel 135, the jamb channel 135 having opposed sides 310. The sliding surfaces 400 of the slide block 200 are proximate to the sides 310 of the jamb channel 135. The slide block 200 is partially supported within the jamb channel 135 by a flexible raised jamb channel face 320 forming a joint channel opening 315.

Figure 4A:
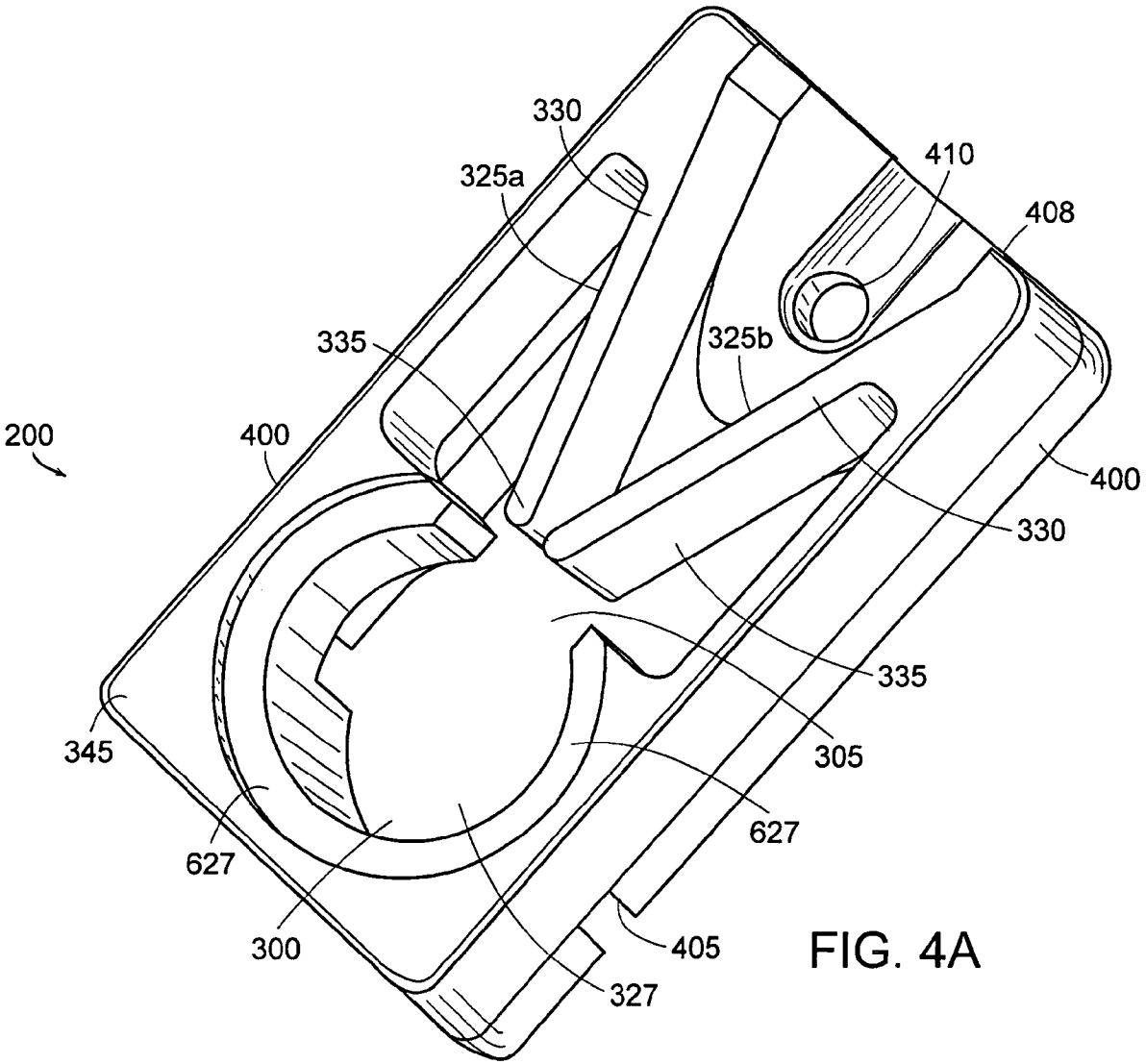
FIG. 4A is a schematic perspective front view of one embodiment of a non-takeout type slide block.

As shown in FIGS. 3 and 4A, the slide block 200 includes a pivot retainer spring, such as first and second sash pivot retainer springs 325*a*, 325*b* (generally 325). The springs 325 each include an elongated locking arm having a first end 330 integrally formed with the slide block 200 and a cantilevered second free end 335 resiliently actuatable between a free-state locking position and a deflected removal position. In various embodiments, the slide block 200 and/or the sash pivot retainer springs 325 may be made from materials including plastics, rubbers, metals, and various combinations of these materials. In a particular embodiment, the slide block 200 is made from a relatively rigid resilient plastic material.

Figure 4B:
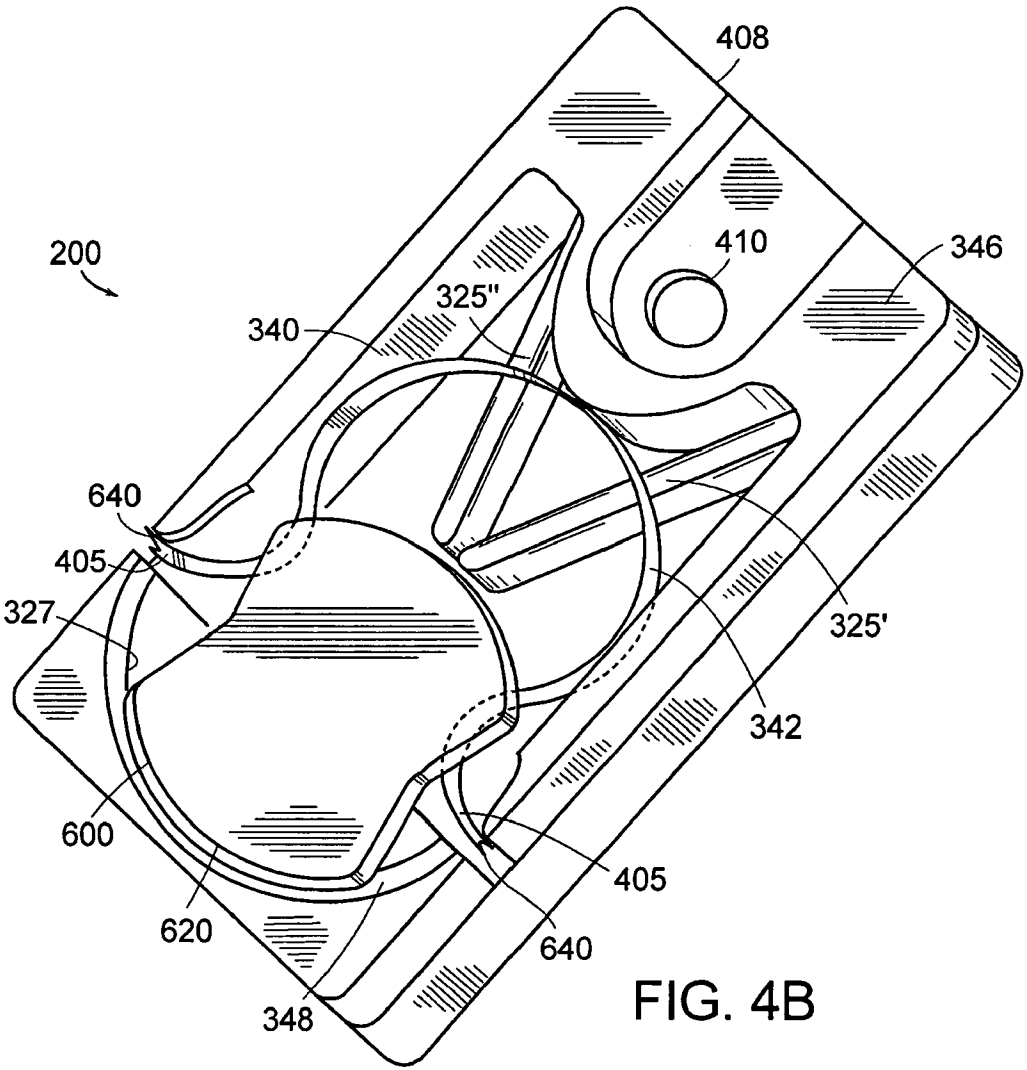
FIG. 4B is a schematic perspective rear view of the non-takeout type slide block of FIG. 4A.
Figure 5:
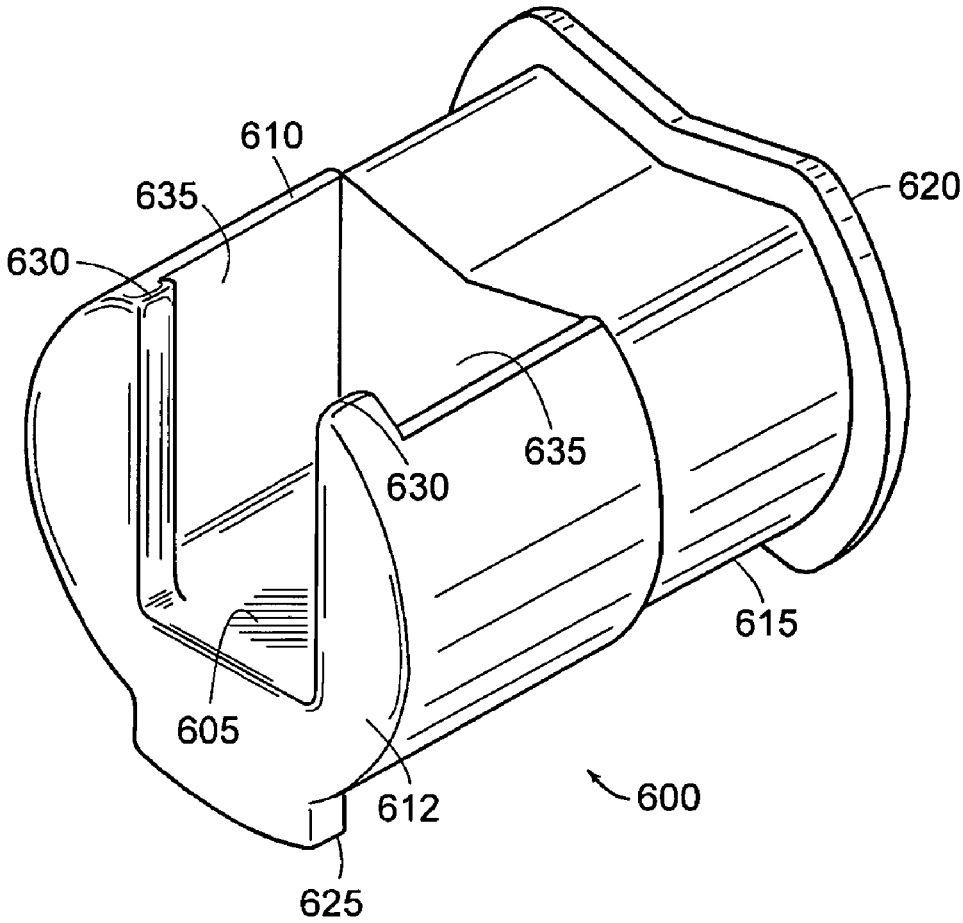
FIG. 5 is a schematic perspective view of one embodiment of a cam in accordance with the invention that may be coupled with the non-takeout type slide block of FIGS. 4A and 4B.

The slide block 200 forms an aperture 327 for receiving an end portion of the pivot 127 and, in typical embodiments, a locking cam 600 (FIG. 5). The slide block 200 can also include a box-like area 340 proximate a rear surface 346 of the slide block 200 for receiving a locking spring 342 (FIG. 4B). Further included in the slide block 200 near its top end 408 is a balance spring mounting hole 410 that receives either a spring counter-balance or a connecting piece that is coupled to the spring counter-balance. Alternatively, the slide block 200 could be directly connected to the spring counter-balance, for example by a screw, bolt, rivet, etc. attached to a U-shaped balance channel. It will be appreciated that the spring counter-balance mounting hole 410 or other mounting feature can be configured in its size and shape to couple with spring counter-balances or connecting pieces having different dimensions and configurations.

As shown in FIGS. 4B and 5, the locking cam 600, which may be operatively disposed in the aperture 327 of the slide block 200, has a head 620 that abuts a ledge 348 proximate the rear surface 346 of the slide block 200 when the locking cam 600 is disposed in the aperture 327. The locking cam 600 also has a tab 625 that abuts a ledge 627 proximate the front surface 345 of the slide block 200 (FIGS. 4A and 5). Together, the head 620 and the tab 625 of the locking cam 600 act to prevent the locking cam 600 from disengaging the slide block 200 in a direction parallel to the horizontal axis 150 when the locking cam 600 is coupled to the slide block 200. The locking cam 600, can be used to retain the locking spring 342 in the box-like area 340 of the slide block 200 when the locking cam 600 is received in the aperture 327 of the slide block 200.

With reference to FIG. 5, also included in the locking cam 600 is a sash pivot opening 605 with an open top slot 610 for receiving the pivot 127. Located proximate a front side 612 of the locking cam 600, on opposite sides of the sash pivot opening 605, are inwardly disposed flanges 630. The locking cam 600 also has camming surfaces 615, to deflect the locking spring 342, as will be described in detail below.

FIGS. 6A and 6B are end and side views, respectively, of one embodiment of the pivot 127. The pivot 127 has two extending arms 505, 506 and an elongated portion 510, the elongated portion 510 having a flange 515 with a width ("W") and a length ("L"), where L and W may be different dimensions. The pivots 127 are received in apertures or retainers disposed in the lower opposite sides of the tiltable sash 125, so that each extending arm 505 is generally parallel to a vertical axis 155 (FIGS. 1 and 8) of the window sash 125 and the extending arm 506 is generally parallel to the horizontal axis 150 of the window sash 125.

Figure 7A:
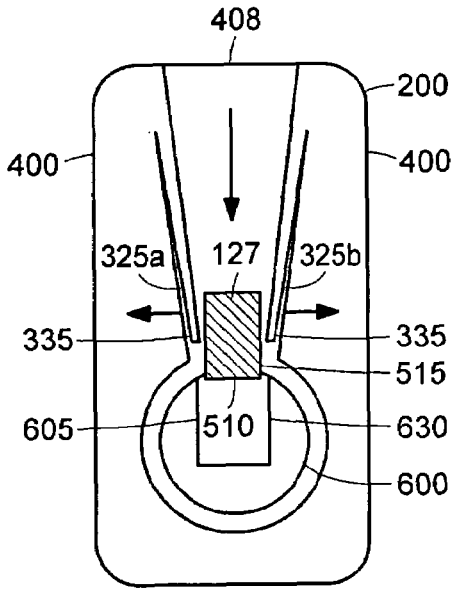
FIG. 7A is a schematic front view of the slide block of FIGS. 4A and 4B with a window sash pivot, shown in cross-section, with the pivot bar being inserted into the slide block.

FIGS. 7A–7D depict the insertion and removal process of the sash 125 into and from the window frame 105. FIG. 7A shows the elongated portion 510 of the pivot 127 being inserted into the slide block 200. As the pivot 127 travels downward into the slide block 200 from the top 408 of the slide block 200, the pivot 127 engages the free ends 335 of the retainer springs 325, which are initially in their locking position occluding at least a portion of the pivot-receiving aperture 327 and/or the sash pivot opening 605. If a locking cam 600 is disposed in the aperture 327, the locking cam 600 is positioned so that the open top slot 610 opens upward, beneath the retainer springs 325. The free ends 335 of the retainer springs 325 are flexible and, upon encountering the pivot 127, deflect outwardly towards the sliding surfaces 400 of the slide block 200, thereby enabling the pivot 127 to enter the pivot-receiving aperture 327 and/or the sash pivot opening 605.

Figure 7B:
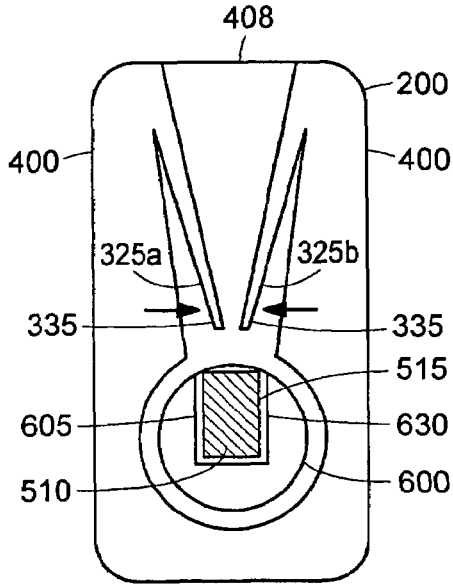
FIG. 7B is a schematic front view of the slide block of FIGS. 4A and 4B with a window sash pivot, shown in cross-section, with the pivot bar inserted into the slide block.
Figure 7C:
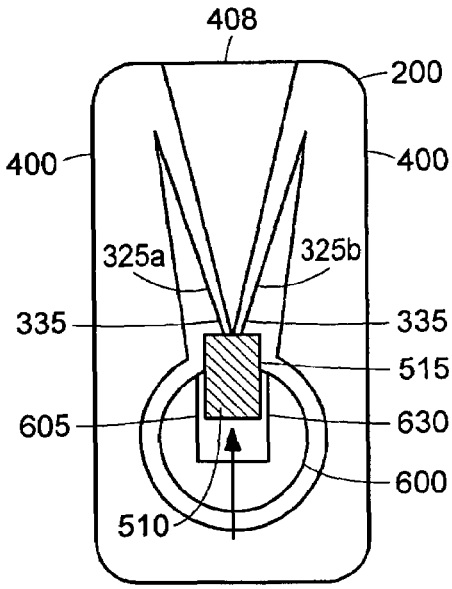
FIG. 7C is a schematic front view of the slide block of FIGS. 4A and 4B with a window sash pivot, shown in cross-section, with the pivot bar locked into the slide block.

As shown in FIG. 7B, once the elongated portion 510 of the pivot 127 slides past the sash pivot retainer springs 325, the retainer springs 325 resiliently return to their locking position above the pivot-receiving aperture 327 and/or the sash pivot opening 605 and occlude at least a portion of the aperture 327 and/or opening 605. In this position, as shown in FIG. 7C, should the pivot 127 slide upwardly, the pivot 127 will abut the free ends 335 of the retainer springs 325 and, thus, be prevented from disengaging the slide block 200. In one embodiment, the angled free ends 335 of the sash pivot retainer springs 325 move toward and engage each other, responsive to an application of a removal force applied to the pivot 127.

Once the pivot 127 has been operatively connected to the locking cam 600, the sash 125 can be tilted into and out of the frame 105. When the sash 125 is in its normal vertical position in the frame 105, the sash pivot opening 605 of the locking cam 600 has rotated approximately 90 degrees from the installation position depicted in FIG. 7A. In this position, the pivot 127 is prevented from disengaging the slide block 200 by the circumferential wall of the aperture 327, the flanges 630, and the inner side walls 635 of the locking cam 600.

Figure 8:
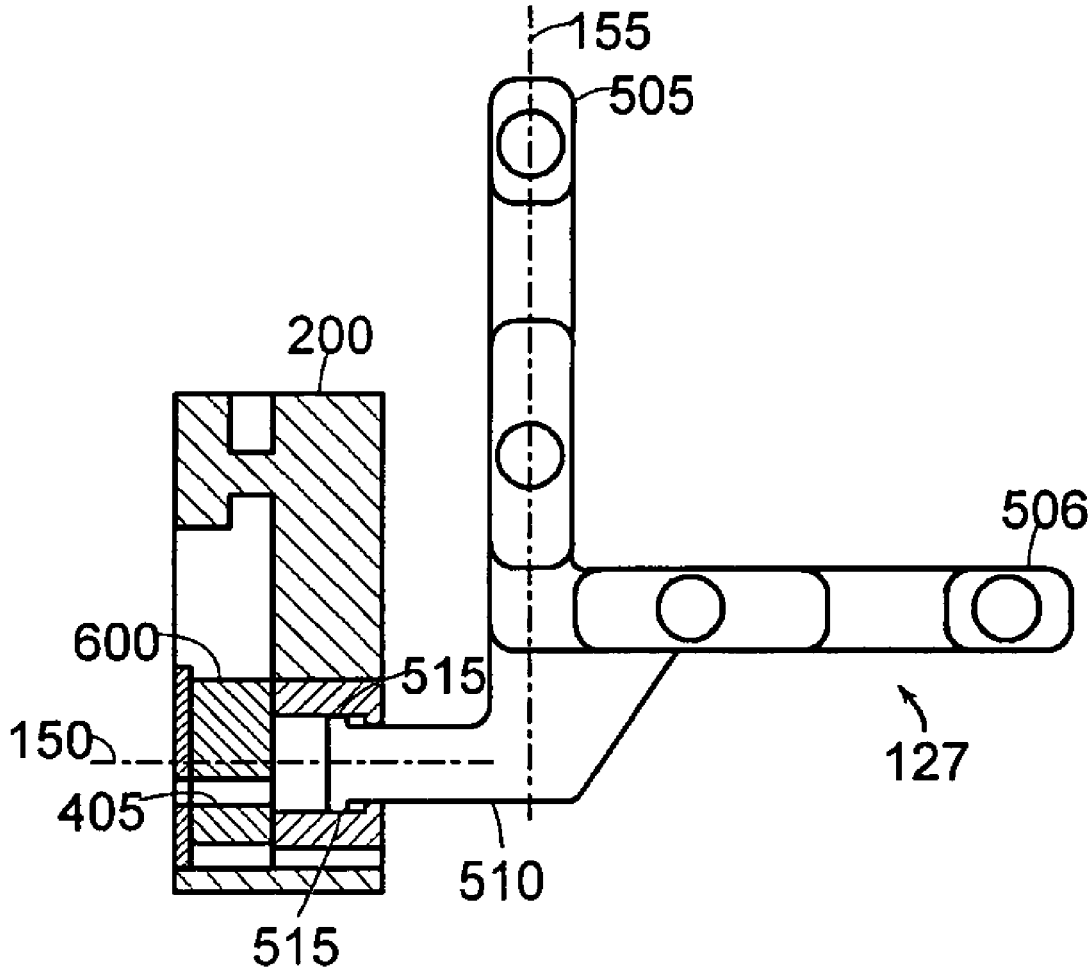
FIG. 8 is a schematic side and partial cross-sectional view of the pivot shown in FIGS. 6A and 6B coupled to the cam shown in FIG. 5, the cam coupled to the non-takeout type slide block of FIGS. 4A and 4B.
Figure 9:
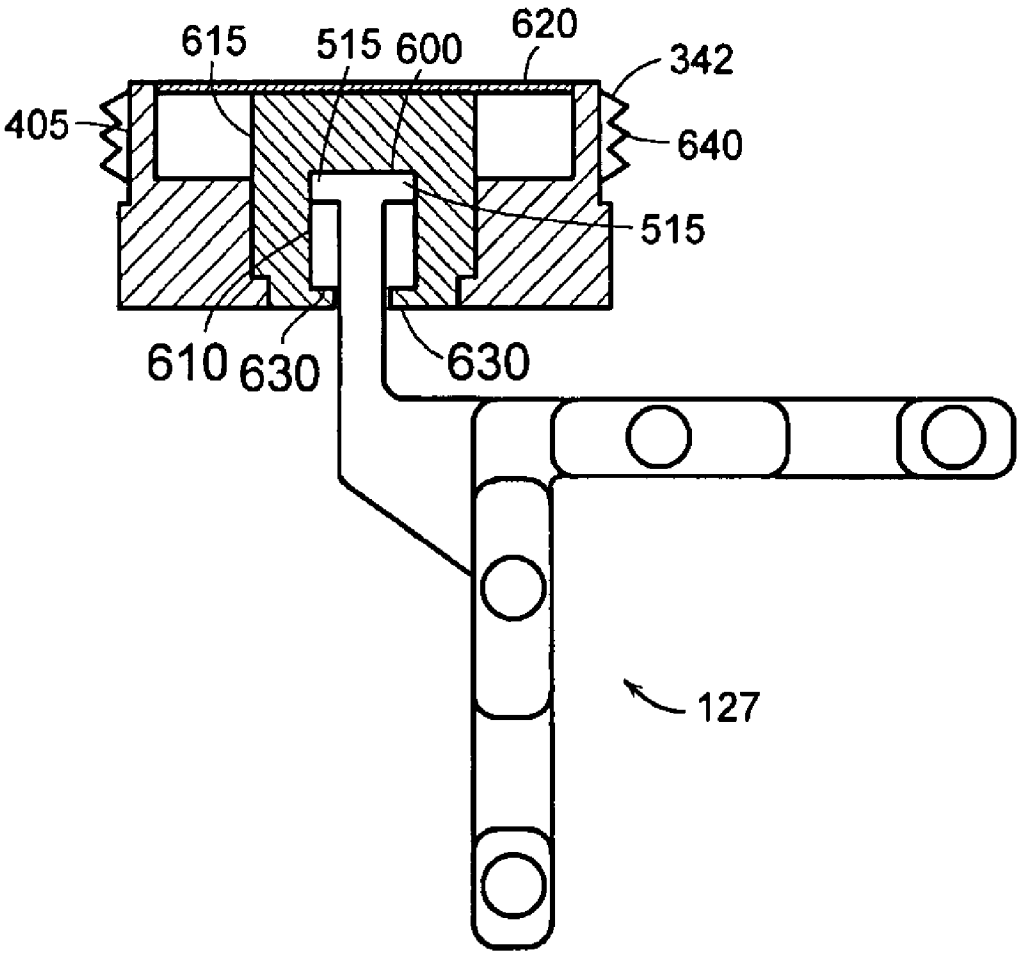
FIG. 9 is a schematic cross-sectional top view of the pivot of FIGS. 6A and 6B coupled to the cam of FIG. 5, the cam coupled to the non-takeout type slide block of FIGS. 4A and 4B.

In addition to restricting vertical movement of the sash 125 relative to the slide block 200 when the pivot 127 is coupled to the slide block 200, horizontal movement of the pivot 127 is also restricted. As shown in FIGS. 8 and 9, when the pivot 127 is inserted into the sash pivot opening 605, the elongated portion 510 of the pivot 127 extends into the sash pivot opening 605 beyond the flanges 630 of the slide block 200. The flanges 515 of the pivot 127 are sized sufficiently wide such that when the pivot 127 is inserted into the locking cam 600, the flanges 515 engage the flanges 630 of the slide block 200, thereby preventing the pivot 127 from being pulled out of the sash pivot opening 605 in a direction generally parallel to the horizontal axis 150 of the elongated portion 510. This feature is particularly beneficial during transport and installation of the window assembly 100. During transport and installation, the side members 110 of the frame 105 may bow outwardly away from the sashes 115, 125, so that without the engagement of the flanges 515 of the pivot 127 with the flanges 630 of the slide block 200, the pivot 127 may disengage from the locking cam 600.

Figure 7D:
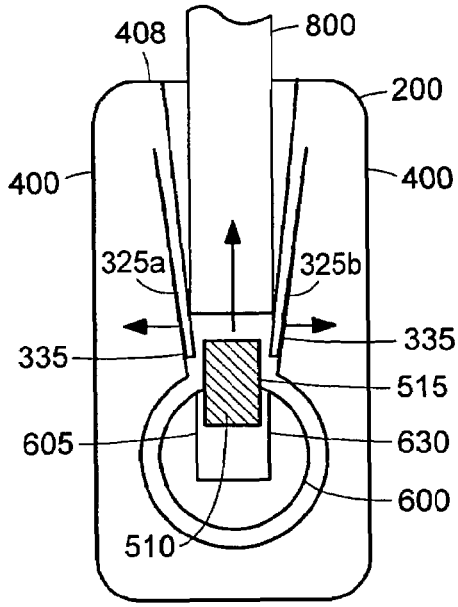
FIG. 7D is a schematic front view of the slide block of FIGS. 4A and 4B with a window sash pivot, shown in cross-section, with the pivot bar being removed from the slide block.

With reference to FIG. 7D, in the event that it is desired to remove the sash 125 from the slide block 200, for instance to replace a broken windowpane, the sash is tilted so that the locking cam 600 is positioned with the open top slot 610 opened upwardly beneath the retainer springs 325. An extraction tool 800 can then be guided from the top end 408 downwardly into the slide block 200. As the extraction tool 800 is inserted into the slide block 200, the sash pivot retainer springs 325 will be deflected outwardly towards the sliding surfaces 400 of the slide block 200 to a removal position, such that they no longer occlude the sash pivot opening 605. The pivot 127, and hence the sash 125, may then be disengaged from the slide block 200 by guiding the pivot 127 upwardly between the retainer springs 325 and out of the open top slot 610 of the locking cam 600.

As shown in FIG. 9, when the sash 125 is tilted into a room for cleaning, the locking cam 600 rotates and the camming surfaces 615 disposed on the locking cam 600 force oppositely disposed serrated end portions 640 of the locking spring 342 through sidewall slots 405 in the slide block 200. The serrated end portions 640 of the spring 342 engage with the jamb channels 135, thereby locking the slide block 200 in a fixed vertical position in the jamb channels 135. Locking the slide block 200 in a vertical position prevents the spring counter-balance from pulling the slide block 200 and the sash 125 upward when the sash 125 is tilted.

When the sash 125 is tilted back into its normal vertical position in the frame 105, the locking cam 600 rotates and the camming surfaces 615 permit the oppositely disposed serrated end portions 640 of the spring 342 to retract back through the slots 405. This action disengages the serrated end portions 640 of the spring 342 from the sides 310 of the jamb channels 135, thereby enabling the slide block 200 and the sash 125 to slide vertically in the jamb channel 135.

Figure 10C:
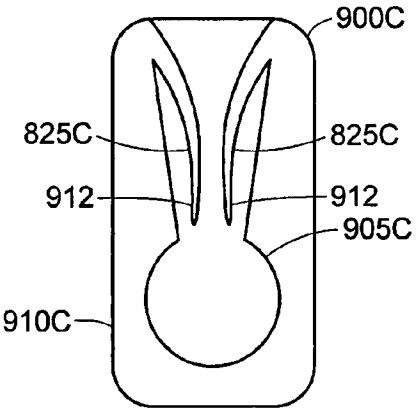
FIG. 10C is a schematic front view of another alternative embodiment of a non-takeout type slide block in accordance with the invention.
Figure 10D:
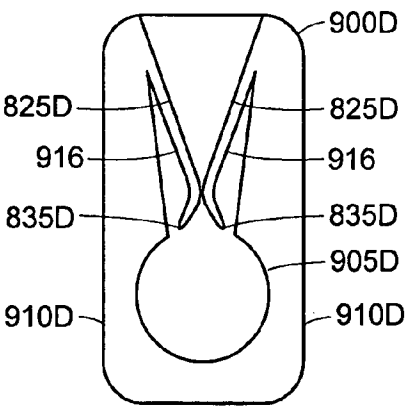
FIG. 10D is a schematic front view of another alternative embodiment of a non-takeout type slide block in accordance with the invention.
Figure 10A:
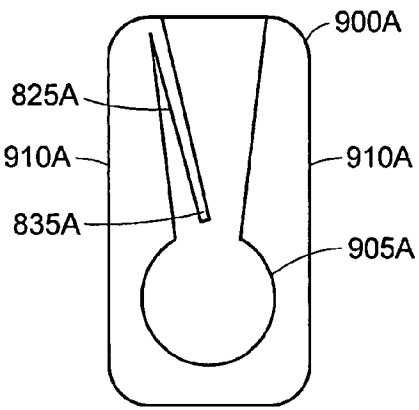
FIG. 10A is a schematic front view of an alternative embodiment of a non-takeout type slide block in accordance with the invention.

FIGS. 10A–10D depict alternative embodiments of slide blocks 900 in accordance with the invention. In one embodiment, as shown in FIG. 10A, the slide block 900A includes a single integral sash pivot retainer spring 825A. The sash pivot retainer spring 825A functions like the sash pivot retainer spring 325 described above and the pivot 127 is inserted into and removed from the slide block 900A as previously described. In the position shown in FIG. 10A, the free end 835A of the sash pivot retainer spring 825A at least partially occludes the open top slot of the aperture 905A and prevents the pivot 127 from disengaging the slide block 900A immediately after the pivot 127 has been inserted or when the sash 125 is tilted into a room.

Figure 10B:
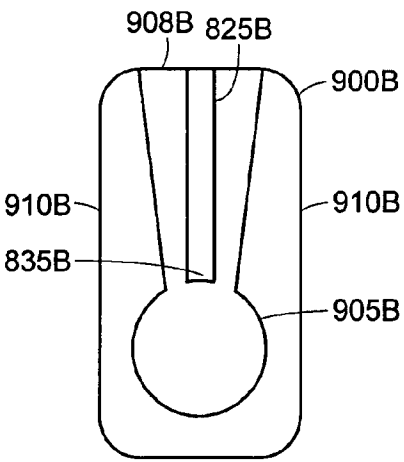
FIG. 10B is a schematic front view of another alternative embodiment of a non-takeout type slide block in accordance with the invention.

FIG. 10B depicts another embodiment of a slide block 900B in accordance with the invention. The slide block 900B includes a sash pivot retainer spring 825B. In this embodiment, the sash pivot retainer spring 825B is integrally formed with the slide block 900B and depends from an approximate midpoint of the top end 908B of the slide block 900B. The sash pivot retainer spring 825B in a normal position covers the pivot-receiving aperture 905B of the slide block 900B. To insert the pivot 127 into the slide block 900B, the pivot 127 is positioned adjacent a side of the sash pivot retainer spring 825B and guided downwardly into the slide block 900B from the top end 908B of the slide block 900B. As the pivot 127 travels downwardly, the sash pivot retainer spring 825B flexes to one side, away from the pivot 127, such that the free end 835B of the sash pivot retainer spring 825B no longer occludes the aperture 905B of the slide block 900B. Since the sash pivot retainer spring 825B no longer occludes the aperture 905B, the pivot 127 can be inserted into the aperture 905B of the slide block 900B. Once the pivot 127 is fully inserted into the aperture 905B, the sash pivot retainer spring 825B springs back to its locking position, at least partially occluding the aperture 905B. In this position, as described above, the pivot 127 is prevented from disengaging the slide block 900B.

To release the pivot 127 from the slide block 900B, the tool 800 previously described can be used to force the free end 835B of the sash pivot retainer spring 825B sideways (i.e. to the left or right), such that the free end 835B of the sash pivot retainer spring 825B no longer occludes the aperture 905B. In this position, the pivot 127, and hence the sash 125, can be guided upwardly out of the slide block 900B.

FIG. 10C depicts yet another embodiment of a slide block 900C in accordance with the invention. The sash pivot retainer springs 825C of this embodiment function like the sash pivot retainer springs 325 described previously. For instance, when the pivot 127 is inserted into the slide block 900C, the sash pivot retainer springs 825C prevent the pivot 127 from disengaging from the slide block 900C. In this embodiment, however, each sash pivot retainer spring 825C has a curvilinear surface 912. The curvilinear surfaces 912 ease the process of guiding the pivot 127 into the slide block 900C and removing the pivot 127 therefrom.

FIG. 10D represents another embodiment of a slide block 900D in accordance with the invention. In this embodiment, the sash pivot retainer springs 825D each have a straight surface 916; however, the free ends 835D of the sash pivot retainer springs 825D are flared. The sash pivot retainer springs 825D of this embodiment function like the sash pivot retainer springs 325 described previously; however, the flared free ends 835D ease the process of removing the pivot 127 from the slide block 900D, since an upward force applied by the pivot 127 will tend to deflect the free ends 835D of the sash pivot retaining springs 910D outwardly towards the sliding surfaces 910D of the slide block 900D. This configuration avoids the need for a removal tool to spread the springs 825D, but requires advertent vertical force to remove the pivot from the block 900D.

In each of the disclosed embodiments, the sash pivot retaining springs can bend or flex in any of several directions. For instance, while the discussion herein has focused on springs pivoting about an axis generally parallel with that of the pivot 127, the springs could pivot about an axis generally perpendicular to the pivot 127 such as into the page (as depicted, for example, in FIGS. 10A–10D) to allow the insertion and removal of the pivot 127 from the slide block.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A slide block for a tilt window sash, comprising:

a body adapted to be received in a window jamb channel, the body defining a sash pivot-receiving aperture;

a first sash pivot retainer spring integrally formed with the body, the spring positionable between a first position obstructing removal of a sash pivot when the sash pivot is disposed in the aperture and a second position permitting removal thereof, the first sash pivot retainer spring comprising an elongated locking arm including a first end integrally formed with the body and a second end deflectable between the first position and the second position; and a second sash pivot retainer spring integrally formed with the body, the second spring positionable between a third position obstructing the removal of the sash pivot when the sash pivot is disposed in the aperture and a fourth position permitting the removal thereof, the second sash pivot retainer spring comprising an elongated locking arm including a first end integrally formed with the body and a second end deflectable between the third position and the fourth position, wherein the respective second ends of the first and second sash pivot retainer springs engage each other responsive to application of a removal force to the sash pivot along a longitudinal axis of said body.

2. The slide block of claim 1, wherein the body further comprises oppositely disposed sliding surfaces for guiding the body in the window jamb channel.

3. The slide block of claim 1, wherein the first and second sash pivot retainer springs are configured opposite each other.

4. The slide block of claim 1, further comprising a locking mechanism for selectively engaging the window jamb channel and locking the block in a fixed position relative thereto.

5. The slide block of claim 4, further comprising:

a cam carried in the body, the cam including camming surfaces to contact and operate the locking mechanism and defining the sash pivot-receiving aperture, the sash pivot-receiving aperture having an open top slot; and the locking mechanism includes a locking spring including oppositely disposed serrated ends, locking the spring disposed about the cam and operated by contacting the camming surfaces.

* * * * *